US012017283B2

(12) United States Patent
Sawai

(10) Patent No.: US 12,017,283 B2
(45) Date of Patent: Jun. 25, 2024

(54) METAL POWDER PRODUCTION METHOD AND METAL POWDER PRODUCTION APPARATUS

(71) Applicant: SEIKO EPSON CORPORATION, Tokyo (JP)

(72) Inventor: Takenori Sawai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/166,723

(22) Filed: Feb. 3, 2021

(65) Prior Publication Data

US 2021/0237154 A1 Aug. 5, 2021

(30) Foreign Application Priority Data

Feb. 4, 2020 (JP) ..... 2020-016819

(51) Int. Cl.
*B22F 9/08* (2006.01)
*B22F 1/102* (2022.01)

(52) U.S. Cl.
CPC ..... *B22F 9/082* (2013.01); *B22F 1/102* (2022.01); *B22F 2201/10* (2013.01); *B22F 2302/45* (2013.01)

(58) Field of Classification Search
CPC ..... B22F 9/082–2009/0828; B01J 2/06
See application file for complete search history.

(56) References Cited

U.S. PATENT DOCUMENTS 4,124,377 A * 11/1978 Larson ..... B22F 9/082 264/13
4,385,929 A * 5/1983 Ichidate ..... B22F 1/145 148/209
6,059,853 A * 5/2000 Coombs ..... B01J 2/003 75/332
2017/0239731 A1* 8/2017 Kaneta ..... B22F 9/082
(Continued)

FOREIGN PATENT DOCUMENTS

JP H01294805 A 11/1989
JP H-0610002 A * 1/1994
JP 2649945 B2 * 9/1997
(Continued)

OTHER PUBLICATIONS

Nolan W.R.; "Electrically Insulating Phosphate Coating for Iron Powder Based Electromagnetic Core Applications"; Massachusetts Institute of Technology; 2009 (Year: 2009).*
(Continued)

*Primary Examiner* — Samir Shah
*Assistant Examiner* — Austin Pollock
(74) *Attorney, Agent, or Firm* — CHIP LAW GROUP

(57) ABSTRACT

A metal powder production method includes a powdering step of causing a jet flow to collide with a molten metal that flows down, thereby powdering the molten metal, and a coating step, for a metal powder, of immersing the powdered molten metal in a liquid containing a non-aqueous liquid, thereby forming a suspension of the metal powder, wherein the powdering step and the coating step are performed in a same apparatus, the non-aqueous liquid contains a raw material of an electrically insulating material, and in the metal powder, a surface is coated with the electrically insulating material.

2 Claims, 1 Drawing Sheet

(56) References Cited

U.S. PATENT DOCUMENTS

2018/0090252 A1* 3/2018 Kudo ..... C22C 38/26

FOREIGN PATENT DOCUMENTS

| | | | | |
|---|---|---|---|---|
| JP | 2009221550 | A | * | 10/2009 |
| JP | 2010001515 | A | * | 1/2010 |
| JP | 2017145493 | A | * | 8/2017 |

OTHER PUBLICATIONS

Eco U.S.A.; "Applications of Silicone Transformer Oil", retrieved from internet on Mar. 24, 2022; http://www.siliconerecycling.com/applications-of-silicone-transformer-oil/ (Year: 2022).*

Feroz S.; "Characteristics of Vegetable Oils as Liquid Insulation for Transformer: An Experimental Study"; vol. 18. 2018 (Year: 2018).*

* cited by examiner

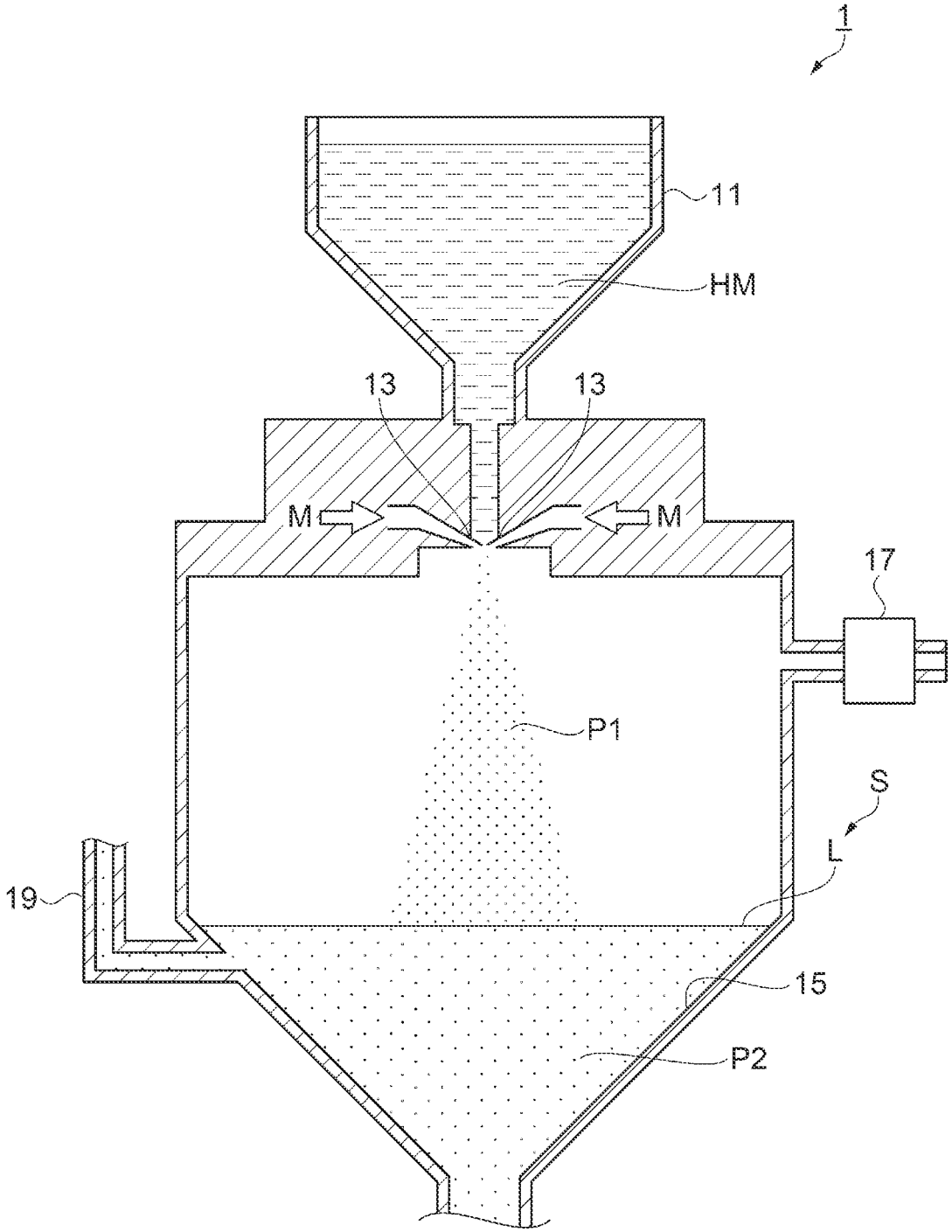
1
11
HM
13
13
M
M
17
P1
S
L
19
15
P2

METAL POWDER PRODUCTION METHOD AND METAL POWDER PRODUCTION APPARATUS

The present application is based on, and claims priority from JP Application Serial Number 2020-016819, filed on Feb. 4, 2020, the disclosure of which is hereby incorporated by reference herein in its entirety.

BACKGROUND

1. Technical Field

The present disclosure relates to a metal powder production method and a metal powder production apparatus.

2. Related Art

Heretofore, an atomization method for producing a metal powder by ejecting an atomizing medium onto a molten metal is known. For example, JP-A-1-294805 (Patent Document 1) proposes a method for producing a metal powder composite material using an emulsion, in which a water-insoluble organic substance is dispersed in water, as an atomizing medium.

However, the method for producing a metal powder composite material described in Patent Document 1 had a problem that it is difficult to prevent contamination of the surface of the metal powder. Specifically, the metal powder composite material is formed by coating the surface of the metal powder with the water-insoluble organic substance in the atomizing medium. When the metal powder composite material is used for a magnetic core or the like, after the water-insoluble organic substance at the surface of the metal powder is removed, the surface of the metal powder is coated with an insulator. Therefore, the surface of the metal powder is sometimes contaminated depending on handling or the like until the surface of the metal powder is coated with the insulator after the water-insoluble organic substance is removed. If the surface of the metal powder is contaminated, it becomes difficult to stably form a film of the insulator, resulting in a variation in the film quality of the insulator coating film, and the insulating property or the like is likely to be unstable. That is, a metal powder production method for forming an insulator coating film with high quality by suppressing contamination of the surface of the metal powder has been demanded.

SUMMARY

A metal powder production method includes a powdering step of causing a jet flow to collide with a molten metal that flows down, thereby powdering the molten metal, and a coating step, for a metal powder, of immersing the powdered molten metal in a liquid containing a non-aqueous liquid, thereby forming a suspension of the metal powder, wherein the powdering step and the coating step are performed in a same apparatus, the non-aqueous liquid contains a raw material of an electrically insulating material, and in the metal powder, a surface is coated with the electrically insulating material.

A metal powder production apparatus is an apparatus, with which a jet flow is caused to collide with a molten metal that flows down to powder the molten metal, thereby producing a metal powder, and includes an ejection portion that ejects the jet flow, and an immersion tank portion that stores a liquid containing a non-aqueous liquid, and immerses the powdered molten metal that falls from the ejection portion in the liquid, wherein the non-aqueous liquid contains a raw material of an electrically insulating material.

BRIEF DESCRIPTION OF THE DRAWINGS

The FIGURE is a schematic cross-sectional view showing a configuration of a metal powder production apparatus according to a first embodiment.

DESCRIPTION OF EXEMPLARY EMBODIMENTS

1. First Embodiment

A configuration of a metal powder production apparatus according to a first embodiment will be described with reference to the FIGURE. In the following description, the upper side in the FIGURE is referred to as "upper part", and the lower side in the FIGURE is referred to as "lower part", and the gravitational force shall act from the upper part to the lower part.

1.1. Metal Powder Production Apparatus

As shown in the FIGURE, a metal powder production apparatus 1 according to this embodiment powders a molten metal HM by an atomization method in which a jet flow of an atomizing medium M is caused to collide with the molten metal HM that flows down to forma plurality of particles of a metal powder P2. The metal powder production apparatus 1 includes a supply portion 11, an ejection portion 13, an immersion tank portion 15, a pressure adjusting valve 17, and a liquid supply pipe 19. In the metal powder production apparatus 1, the supply portion 11, the ejection portion 13, and the immersion tank portion 15 are disposed in this order from the upper part to the lower part.

The supply portion 11 temporarily stores the molten metal HM, and also causes the molten metal HM to flow down to the ejection portion 13. The supply portion 11 is in a cylindrical shape in an upper part and is narrowed in a tapered shape in a lower part. The upper part of the supply portion 11 is released to the outside. Although not shown in the FIGURE, the supply portion 11 may be provided with a device that melts a solid metal which is a raw material of the molten metal HM or the like, and a pipe through which the molten metal HM is supplied may be coupled thereto. For the melting of the raw material of the molten metal HM, a known heating unit may be adopted.

The molten metal HM is in a liquid form and has fluidity so as to flow down from the supply portion 11 by the gravitational force and reach the ejection portion 13. A region where the molten metal HM flows between the supply portion 11 and the ejection portion 13 is in a cylindrical shape narrower than the supply portion 11.

The ejection portion 13 is a plurality of nozzles, which are provided in an inner wall, and in which the molten metal HM flows down. The ejection portion 13 ejects a jet flow of the atomizing medium M toward the molten metal HM that are flowing down. The atomizing medium M is a liquid or a gas. In this embodiment, a gas atomization method using a gas as the atomizing medium M is adopted. Although illustration is omitted, the atomizing medium M is stored in the ejection portion 13, and also a pressure feeder that ejects the atomizing medium M as a jet flow at a high pressure is coupled thereto.

By the collision of the jet flow of the atomizing medium M, the molten metal HM is divided into a plurality of liquid droplets and solidified. The solidified plurality of liquid droplets are formed into a plurality of particles of a powder P1 and naturally falls to the immersion tank portion 15.

The immersion tank portion 15 is in a cylindrical shape in an upper part and is narrowed in a tapered shape in a lower part. The immersion tank portion 15 stores a liquid containing a non-aqueous liquid L, and the powder P1 of the powdered molten metal HM that falls from the ejection portion 13 is immersed in the liquid.

In the immersion tank portion 15, for example, a gas-liquid interface of the liquid is present around the middle in the vertical direction of the immersion tank portion 15. That is, in the inside of the immersion tank portion 15, the upper part is a gas phase, and the lower part is a liquid phase.

The gas phase may contain an inert gas such as helium gas, argon gas, or nitrogen gas. By containing an inert gas in the gas phase, the formation of an oxide film at the surface of the powder P1 is suppressed.

The non-aqueous liquid L contained in the liquid contains a raw material of an electrically insulating material. The powder P1 is solidified in the ejection portion 13, but is still at a high temperature even after passing through the gas phase of the immersion tank portion 15. Therefore, when the powder P1 which is still at a high temperature is immersed in the liquid, due to the heat of the powder P1, the raw material of the electrically insulating material reacts, and a coating film of the electrically insulating material is formed at the surface of the powder P1. That is, in the liquid, from the powder P1 and the non-aqueous liquid L, the metal powder P2 in which the surface of the powder P1 is coated with the electrically insulating material is formed.

The liquid containing the non-aqueous liquid L not only forms a coating film of the electrically insulating material at the surface of the powder P1 to form the metal powder P2, but also functions as a cooling liquid for cooling the powder P1. The plurality of particles of the metal powder P2 are dispersed in the liquid, whereby the liquid phase of the immersion tank portion 15 is converted into a suspension S containing the metal powder P2. The electrically insulating material, the reaction of the raw material thereof, and the like will be described later.

The pressure adjusting valve 17 is coupled to the gas phase side in the upper part of the immersion tank portion 15. The pressure adjusting valve 17 is a check valve and adjusts the internal pressure of the immersion tank portion 15 that is raised by the flow-down of the molten metal HM or the ejection of the atomizing medium M. The pressure adjusting valve 17 is operated and released only when the internal pressure is a predetermined value or higher, and is closed when it is not operated. The internal pressure is adjusted to, for example, 1 Pa or more and 0.2 MPa or less.

To the lower part of the immersion tank portion 15, the liquid supply pipe 19 for supplying the liquid containing the non-aqueous liquid L is coupled. The liquid supply pipe 19 is coupled to a liquid storage portion (not shown) and supplies the liquid to the immersion tank portion 15 after the metal powder P2 is taken out or the like.

Although illustration is omitted, a valve is provided at the lower part of the immersion tank portion 15, and an outlet is provided at a further lower part of the valve. When the suspension S is taken out from the metal powder production apparatus 1, the valve is opened and the suspension S is discharged from the outlet.

By the pressure adjusting valve 17 or the valve at the lower part of the immersion tank portion 15 described above, or the like, when powdering the molten metal HM and forming the metal powder P2, the ejection portion 13 and the immersion tank portion 15 in the metal powder production apparatus 1 are each made to be an airtight space. The metal powder production apparatus 1 itself may be provided in an airtight space.

1.2. Metal Powder Production Method

A metal powder production method using the metal powder production apparatus 1 will be described. In this embodiment, as the metal powder P2, a magnetic alloy powder in which the surface is coated with an electrically insulating material is shown as an example. The magnetic alloy powder is, for example, favorably used for a magnetic core or the like. The molten metal HM that is one of the forming materials of the metal powder P2 is not limited to a magnetic material.

A method for producing the metal powder P2 of this embodiment includes a powdering step and a coating step. The powdering step and the coating step are performed in the metal powder production apparatus 1 that is the same apparatus.

In the powdering step, from the ejection portion 13, a jet flow of the atomizing medium M is caused to collide with the molten metal HM that flows down from the supply portion 11 to powder the molten metal HM, thereby forming a plurality of particles of the powder P1.

The molten metal HM contains a soft magnetic material. Examples of the soft magnetic material include pure iron, various types of Fe-based alloys such as an Fe—Si-based alloy such as silicon steel, an Fe—Ni-based alloy such as permalloy, an Fe—Co-based alloy such as permendur, an Fe—Si—Al-based alloy such as Sendust, an Fe—Cr—Si-based alloy, and an Fe—Cr—Al-based alloy, various types of Ni-based alloys, and various types of Co-based alloys. Among these, various types of Fe-based alloys are preferably used from the viewpoint of magnetic properties such as magnetic permeability and magnetic flux density, and productivity such as cost.

The crystal property of the soft magnetic material is not particularly limited, and a crystalline form and an amorphous form are exemplified. The soft magnetic material preferably contains an amorphous phase from the viewpoint of reduction in coercive force.

Examples of the soft magnetic material capable of forming an amorphous form include Fe-based alloys such as Fe—Si—B-based, Fe—Si—B—C-based, Fe—Si—B—Cr—C-based, Fe—Si—Cr-based, Fe—B-based, Fe—P—C-based, Fe—Co—Si—B-based, Fe—Si—B—Nb-based, and Fe—Zr—B-based alloys, Ni-based alloys such as Ni—Si—B-based and Ni—P—B-based alloys, and Co-based alloys such as Co—Si—B-based alloys. In the molten metal HM, multiple types of soft magnetic materials having different crystal properties may be used.

The soft magnetic material is preferably contained in an amount of 50 vol % or more, more preferably 80 vol % or more, further more preferably 90 vol % or more with respect to the packed volume of the metal powder P2. According to this, the soft magnetism of the metal powder P2 is improved. The "packed volume" refers to an actual volume occupied by the soft magnetic powder in a green compact obtained by compacting the metal powder P2, and can be measured by a liquid displacement method, a gas displacement method, or the like.

The metal powder P2 may contain an impurity or an additive other than the soft magnetic material. Examples of the additive include various types of metal materials, various types of non-metal materials, and various types of metal oxide materials.

As described above, the components of the molten metal HM are melted to form the molten metal HM, which is temporarily stored in the supply portion 11. Subsequently, the molten metal HM is allowed to flow down to the ejection portion 13 from the supply portion 11, and a jet flow of the atomizing medium M is caused to collide with the molten metal HM from the ejection portion 13.

In this embodiment, a gas atomization method is adopted, and therefore, as the atomizing medium M, a gas is used. In the gas, an inert gas such as nitrogen gas, helium gas, or argon gas may be contained. By containing an inert gas in the atomizing medium M, a rapid reaction or the like due to contact between the molten metal HM and the atomizing medium M can be suppressed. Further, as the atomizing medium M, air may be used.

In this embodiment, nitrogen gas is used as the atomizing medium M, and also the ejection portion 13, the immersion tank portion 15, and the like in the metal powder production apparatus 1 are filled with nitrogen gas. Further, as described above, when powdering the molten metal HM and forming the metal powder P2, the ejection portion 13 and the immersion tank portion 15 are each made to be an airtight space. Therefore, the powdering step and the below-mentioned coating step are performed in an inert gas atmosphere and an airtight space.

The molten metal HM is divided into a plurality of liquid droplets by causing the jet flow of the atomizing medium M to collide with the molten metal HM. The plurality of liquid droplets are solidified to form a plurality of particles of the powder P1, which naturally fall through the gas phase of nitrogen gas in the upper part of the immersion tank portion 15 and are immersed in the liquid phase in the lower part of the immersion tank portion 15.

The average particle diameter of the powder P1 is not particularly limited, but is, for example, 0.25 μm or more and 250.00 μm or less. The average particle diameter as used herein refers to a volume-based particle size distribution (50%). The average particle diameter is measured by a dynamic light scattering method ora laser diffraction method described in JIS Z 8825. Specifically, for example, a particle size distribution meter using a dynamic light scattering method as a measurement principle can be adopted. Then, the process proceeds to the coating step.

In the coating step, the powder P1 of the powdered molten metal HM is immersed in the liquid containing the non-aqueous liquid L, whereby the suspension S of the metal powder P2 is formed.

The non-aqueous liquid L contains a raw material of the electrically insulating material. The raw material contains, for example, a polysiloxane compound. Examples of the polysiloxane compound include silicone oils such as dimethyl silicone oil, methyl phenyl silicone oil, and modified silicone oil. The physical properties such as viscosity and the degree of polymerization of such a silicon oil are not particularly limited, and may be appropriately changed according to the type of the molten metal HM or the like. As such a silicone oil, a commercially available product may be used.

The liquid containing the non-aqueous liquid L may be the non-aqueous liquid L itself, or may contain the non-aqueous liquid L in a dissolved or dispersed state. A medium containing the non-aqueous liquid L in a dissolved or dispersed state is not particularly limited, and a known liquid can be adopted. In this embodiment, dimethyl silicone oil is adopted as the raw material of the electrically insulating material, and dimethyl silicone oil, which is the non-aqueous liquid L, itself is used as the liquid. In this embodiment, as a commercially available product of dimethyl silicone oil, dimethyl silicone KF-96 of Shin-Etsu Silicone Co. Ltd. is used.

When the powder P1 is immersed in the liquid containing the non-aqueous liquid L, due to the heat of the powder P1, a Si—C bond or the like in the molecular structure in the polysiloxane compound is cleaved, and a side chain is detached. On the other hand, a siloxane bond which is a main skeleton of the polysiloxane compound has a relatively large binding energy, and therefore is left without being cleaved. Then, silicon oxide that is an electrically insulating material is formed by a reaction of dangling bonds or the like formed by the detachment of side chains.

When oxygen is contained in the system of the above reaction, silicon dioxide is easily formed as the silicon oxide, and when oxygen is not contained in the system of the above reaction, silicon monoxide is easily formed. Therefore, the oxidation number of the silicon oxide to be formed is not limited to +4 or +2 on average, and may be a value between +2 and +4.

The reaction in which silicon oxide is formed from the polysiloxane compound proceeds by the heat of the powder P1, and therefore proceeds at the surface of the powder P1. Due to this, a coating film of silicon oxide is formed at the surface of the powder P1, and the metal powder P2 in which the surface is coated with the electrically insulating material is formed. The electrically insulating material coats at least a portion of the surface of the metal powder P2, for example, in an island shape. From the viewpoint of enhancing the insulating function or the like, the electrically insulating material preferably coats the entire surface of the metal powder P2.

In this manner, when the powder P1 is immersed in the liquid containing the non-aqueous liquid L, the metal powder P2 is sequentially formed, and the liquid containing the non-aqueous liquid L is converted into the suspension S in which the metal powder P2 is dispersed. Then, the process proceeds to the subsequent step.

Subsequently, the suspension S is taken out from the outlet at the lower part of the immersion tank portion 15. Thereafter, from the resulting suspension S, the liquid containing the non-aqueous liquid L is removed, whereby the metal powder P2 is obtained. As a method for removing the liquid, a centrifugation treatment, a heating treatment, a filtration treatment, or the like is exemplified. Further, the metal powder P2 may be taken out from the liquid. Specifically, for example, by using a magnet such as an electromagnet capable of turning on and off the magnetic force, the metal powder P2 is attracted and taken out from the liquid. Among the treatments, one type of treatment is performed alone or multiple types of treatments are performed. The metal powder P2 is produced through the steps described above.

The film thickness of the electrically insulating material in the metal powder P2 is preferably set to 1 nm or more and 20 nm or less, and is more preferably 3 nm or more and 5 nm or less from the viewpoint of insulating properties, magnetic properties, or the like. The film thickness can be found from the average of the film thickness measured at 5 or more sites by observing the cross section of the metal powder P2 using a transmission electron microscope or the like.

The volume resistivity of the electrically insulating material that coats the metal powder P2 is $1\times10^{14}$ Ω·cm or more and $1\times10^{17}$ Ω·cm or less. According to this, the DC dielectric strength and magnetic permeability in the metal powder P2 are improved. The volume resistivity of the electrically insulating material can be measured by a known measurement method.

The metal powder P2 is favorably used for a magnetic core included in a coil part such as an inductor or a toroidal coil, and for a soft magnetic part other than the coil part such as a motor, an antenna, or an electromagnetic wave absorber. The metal powder P2 is compaction-molded into a desired shape according to the intended use thereof.

According to this embodiment, the following effect can be obtained.

The coating film of the electrically insulating material with high quality can be formed by preventing contamination of the surface of the metal powder P2. Specifically, by contact between the powder P1 of the molten metal HM and the non-aqueous liquid L, the coating film of the electrically insulating material is formed at the surface of the metal powder P2. That is, the powdering of the molten metal HM and the formation of the coating film of the electrically insulating material for the surface of the metal powder P2 are performed in the same metal powder production apparatus 1. Therefore, as compared with a case where the coating film of the electrically insulating material is separately formed after the powdering, contamination of the surface of the metal powder P2 is suppressed. According to this, the metal powder production apparatus 1 and the metal powder production method, with which the coating film of the electrically insulating material with high quality is formed by preventing contamination of the surface of the metal powder P2 can be provided.

A step of removing contaminants at the surface of the metal powder P2 becomes unnecessary before forming the coating film of the electrically insulating material. Therefore, the productivity can be improved due to the shortening of the production process for the metal powder P2 and reduction of the production cost.

The powdering step and the coating step are performed in a nitrogen gas atmosphere which is an inert gas atmosphere, and therefore, a rapid reaction, volume expansion, or the like due to contact between the molten metal HM or the powder P1 at a high temperature and the liquid containing the non-aqueous liquid L can be suppressed. The powdering step and the coating step are performed in an airtight space, and therefore, intrusion of contaminants from the outside is suppressed, and contamination of the surface of the metal powder P2 can be more highly prevented.

From the polysiloxane compound contained in the non-aqueous liquid L, silicon oxide having a relatively favorable insulating property can be formed as an electrically insulating material.

2. Second Embodiment

A metal powder production method according to a second embodiment will be described. The metal powder production method of this embodiment is used for producing a metal powder using the metal powder production apparatus 1 in the same manner as in the first embodiment. Further, as the metal powder, a magnetic alloy powder in which the surface is coated with an electrically insulating material is shown as an example.

The metal powder production method of this embodiment is different from that of the first embodiment in that as the atomizing medium M in the metal powder production apparatus 1, the inert gas is replaced by a liquid containing a polysiloxane compound, and the like. Specifically, the jet flow of the atomizing medium M is a liquid containing the non-aqueous liquid L, and the non-aqueous liquid L contains a polysiloxane compound that is a raw material of the electrically insulating material. In the following description, a repetitive description of the same configuration as that of the first embodiment will be omitted.

The atomizing medium M may be the non-aqueous liquid L itself, or an emulsion containing the non-aqueous liquid L as a dispersoid, or a solution containing the non-aqueous liquid L as a solute, or a mist containing the non-aqueous liquid L itself or a liquid containing the non-aqueous liquid L as fine liquid droplets. Further, a raw material of the electrically insulating material in the non-aqueous liquid L in the atomizing medium M may be the same as or different from the raw material of the electrically insulating material contained in the liquid phase of the immersion tank portion 15.

In this embodiment, an atomization method using the polysiloxane compound, which is the non-aqueous liquid L, itself as the atomizing medium M is adopted. As the raw material of the electrically insulating material, the same raw material as in the first embodiment can be adopted. In this embodiment, the same dimethyl silicone oil is used in the liquid phase of the immersion tank portion 15 and the atomizing medium M. Further, the liquid containing the non-aqueous liquid L which is the liquid phase is not limited to the non-aqueous liquid L itself in the same manner as in the first embodiment, and may be a liquid containing the non-aqueous liquid L in a dissolved or dispersed state.

Since the atomizing medium M contains the non-aqueous liquid L, in the powdering step, not only the powdering of the molten metal HM, but also the coating of the formed powder with the electrically insulating material proceeds. That is, the atomizing medium M has a function of dividing the molten metal HM into a plurality of liquid droplets by collision and solidifying the liquid droplets, and also has a function of coating the surface of the formed powder P1 with silicon oxide. That is, the powdering and the formation of the coating are allowed to proceed in parallel. The reaction of the polysiloxane compound at the surface of the powder P1 is the same as the reaction in the liquid phase of the immersion tank portion 15 described above.

The gas phase in the ejection portion 13 and the upper part of the immersion tank portion 15 may be filled with an inert gas in the same manner as in the first embodiment. Alternatively, the gas phase in the ejection portion 13 and the upper part of the immersion tank portion 15 may contain moisture. By the moisture, a reaction to form silicon oxide from the polysiloxane compound in which a side chain is cleaved is promoted. The amount of moisture contained in the gas phase is preferably 200 ppm or more, more preferably 1000 ppm or more from the viewpoint of promotion of the reaction. The amount of moisture in the gas phase can be measured by, for example, a known Karl Fischer Moisture Meter or the like.

The powder resulting from powdering and formation of the coating film by the atomizing medium M is immersed in the liquid phase in the lower part of the immersion tank portion 15 by natural fall. Since the liquid phase contains the non-aqueous liquid L, coating of the powder P1 further proceeds. In this manner, the suspension S containing the metal powder P2 of this embodiment is obtained.

According to this embodiment, the following effect can be obtained in addition to the effects of the first embodiment.

The molten metal HM that flows down and the raw material of the electrically insulating material in the atomizing medium M come into contact with each other, and therefore, in the powdering step, also the coating of the surface of the powder P1 with the electrically insulating material is simultaneously carried out. Due to this, contamination of the surface of the metal powder P2 can be further suppressed. In addition, coating proceeds also in the liquid phase of the immersion tank portion 15, and therefore, the coverage of the surface of the metal powder P2 with the electrically insulating material can be further enhanced. Further, the production efficiency can also be improved due to the enhancement of the coverage.

3. Third Embodiment

A metal powder production method according to a third embodiment will be described. The metal powder production method of this embodiment is used for producing the metal powder P2 using the metal powder production apparatus 1 in the same manner as in the first embodiment. Further, as the metal powder P2, a magnetic alloy powder in which the surface is coated with an electrically insulating material is shown as an example.

The metal powder production method of this embodiment is different from that of the second embodiment in that as the atomizing medium M, the non-aqueous liquid L is replaced by an emulsion containing the non-aqueous liquid L as a dispersoid. Specifically, the jet flow of the atomizing medium M is an emulsion containing the non-aqueous liquid L, and contains a polysiloxane compound that is a raw material of an electrically insulating material. Therefore, a repetitive description of the same configuration as that of the second embodiment will be omitted.

The atomizing medium M of this embodiment contains the polysiloxane compound that is the non-aqueous liquid L as the dispersoid of the emulsion. The atomizing medium M may contain the non-aqueous liquid L as the dispersoid or may contain a liquid containing the non-aqueous liquid L as the dispersoid.

In this embodiment, as the dispersoid of the emulsion that is the atomizing medium M, the polysiloxane compound, which is the non-aqueous liquid L, itself is used. As the raw material of the electrically insulating material, the same raw material as in the first embodiment can be adopted. In this embodiment, the same dimethyl silicone oil is used in the liquid phase of the immersion tank portion 15 and the dispersoid. As the liquid containing the non-aqueous liquid L that is the liquid phase of the immersion tank portion 15, the same emulsion as the atomizing medium M of this embodiment may be used.

In the atomizing medium M of this embodiment, the polysiloxane compound that is the dispersoid is dispersed in a dispersion medium as relatively small liquid droplets without forming a micelle. That is, the emulsion of the atomizing medium M does not contain a dispersant such as a surfactant. Therefore, an organic substance such as a surfactant is not adhered to the surface of the powdered molten metal HM, and the quality of the coating film of the electrically insulating material is improved.

Note that a polysiloxane compound having a substituent with high affinity for the dispersion medium is used, and the polysiloxane compound may be dispersed. The substituent with high affinity refers to, for example, a hydrophilic group when the dispersion medium is hydrophilic, and a hydrophobic group when the dispersion medium is hydrophobic.

The dispersion medium of the emulsion is not particularly limited as long as the emulsion can be formed, but for example, water, a polyhydroxy alcohol-based solvent such as glycol or glycerin, and the like are exemplified, and among these, one or more types are used.

As a method for forming the emulsion that is the atomizing medium M, a method in which the dispersoid and the dispersion medium are mixed, and then, an ultrasonic wave is applied to the mixture, a method in which a shear force by mechanical stirring is applied, a method in which a pressure at the time of ejection from the ejection portion 13 is used, and the like are exemplified. Therefore, in the metal powder production apparatus 1, a configuration enabling such a method may be included. The configuration other than the above-mentioned configuration is the same as that of the second embodiment.

According to this embodiment, the same effect as that of the second embodiment can be obtained.

What is claimed is:

1. A metal powder production method, comprising:

a powdering step of causing a jet flow, of an atomizing medium, to collide with a molten metal that flows down, thereby powdering the molten metal; and a coating step, for a metal powder, of immersing the powdered molten metal in a liquid containing a non-aqueous liquid, thereby forming a suspension of the metal powder, wherein the liquid in which the powdered molten metal is immersed is in a lower part of a gas-liquid interface, the powdered molten metal is passed through an inert gas in an upper part of the gas-liquid interface prior to the immersion, the powdering step and the coating step are performed in a same apparatus, the powdering step and the coating step are performed in an airtight space, the atomizing medium contains a first raw material of a first electrically insulating material, the non-aqueous liquid contains a second raw material of a second electrically insulating material, a surface of the powdered molten metal is coated, in the powdering step, with the first electrically insulating material, and the surface of the metal powder is coated, in the coating step, with the second electrically insulating material.

2. The metal powder production method according to claim 1, wherein the second raw material contains a polysiloxane compound.

* * * * *